US010996011B2

(12) United States Patent
McCallum et al.

(10) Patent No.: US 10,996,011 B2
(45) **Date of Patent: *May 4, 2021**

(54) CALIBER MODIFICATION USING MODULAR FIRE CONTROL GROUP

(71) Applicant: Palmetto State Armory, LLC, Greenville, SC (US)

(72) Inventors: Jamin McCallum, Lexington, SC (US); Paul Wolfe, Lexington, SC (US)

(73) Assignee: PALMETTO STATE ARMORY LLC, Columbia, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/246,591

(22) Filed: Jan. 14, 2019

(65) Prior Publication Data

US 2020/0025482 A1 Jan. 23, 2020

Related U.S. Application Data

(63) Continuation of application No. 15/638,529, filed on Jun. 30, 2017, now Pat. No. 10,215,517.

(60) Provisional application No. 62/356,564, filed on Jun. 30, 2016.

(51) Int. Cl.

| | |
|---|---|
| ***F41A 11/02*** | (2006.01) |
| ***F41A 19/15*** | (2006.01) |
| ***F41A 19/10*** | (2006.01) |
| ***F41A 19/43*** | (2006.01) |

(52) U.S. Cl.

CPC ..... *F41A 11/02* (2013.01); *F41A 19/10* (2013.01); *F41A 19/15* (2013.01); *F41A 19/43* (2013.01)

(58) Field of Classification Search

CPC ..... F41A 11/02; F41A 19/10; F41A 19/15; F41A 3/64; F41A 3/66

See application file for complete search history.

(56) References Cited

U.S. PATENT DOCUMENTS

| | | | | |
|---|---|---|---|---|
| 4,463,654 | A | 8/1984 | Barnes et al. | |
| 4,920,678 | A | 5/1990 | Small | |
| 5,046,275 | A | 9/1991 | Small | |
| 5,900,577 | A | 5/1999 | Robinson et al. | |
| 6,212,814 | B1 | 4/2001 | Lambie | |
| 6,250,194 | B1 | 6/2001 | Brandl et al. | |
| 7,131,228 | B2 * | 11/2006 | Hochstrate | F41C 23/16 42/75.01 |
| 7,810,271 | B2 * | 10/2010 | Patel | F41A 11/02 42/75.03 |
| 8,127,480 | B1 * | 3/2012 | McManus | F41A 9/82 42/49.02 |
| 8,789,305 | B1 * | 7/2014 | DiChario | F41A 3/66 42/75.03 |
| 9,528,782 | B2 * | 12/2016 | Meier | F41A 3/66 |
| 9,823,031 | B2 | 11/2017 | Robbins et al. | |

(Continued)

OTHER PUBLICATIONS

Nick Leghorn, "Gun Review: MGI Hydra MARCK-15", Jul. 21, 2014, thetruthaboutguns.com (Year: 2014).*

(Continued)

*Primary Examiner* — Joshua T Semick

(74) *Attorney, Agent, or Firm* — Burr & Forman LLP; Douglas L. Lineberry

(57) ABSTRACT

The present invention relates to an assembly for modifying a rifle to accommodate various calibers of ammunition and method for changing calibers in a rifle using same.

7 Claims, 7 Drawing Sheets

(56) References Cited

U.S. PATENT DOCUMENTS

| | | | | |
|---|---|---|---|---|
| 9,823,035 | B2 | 11/2017 | Geissele et al. | |
| 2016/0033218 | A1* | 2/2016 | Folkestad, II | F41A 3/66 89/194 |

OTHER PUBLICATIONS

Nick Leghorn, "Gun Review: MGI Hydra MARCK-15", Jul. 21, 2014, http://www.thetruthaboutguns.com/2014/07/foghorn/gun-review-mgi-hydra-marck-15/.

* cited by examiner

CALIBER MODIFICATION USING MODULAR FIRE CONTROL GROUP

BACKGROUND OF THE INVENTION

1) Field of the Invention

The present invention relates to an assembly for modifying a rifle to accommodate various calibers of ammunition and a method for changing calibers in a rifle using same.

2) Description of Related Art

The AR-15 platform rifles are among the most popular firearms being sold. Essentially, they are today's modern sporting rifle. The AR in "AR-15" rifle stands for "ArmaLite Rifle", after the company that developed it in the 1950s. The AR-15 is a military and civilian gas-operated rifle that has been produced in many different versions, including semi-automatic, burst fire, and fully automatic variants. It is lightweight, magazine-fed, air-cooled, fires an intermediate cartridge, and is manufactured with extensive use of aluminum alloys and synthetic materials.

The AR-15 was first built in 1959 by ArmaLite as a small arms rifle for the United States armed forces. Because of financial problems, ArmaLite sold the design to Colt. After some modifications, the redesigned rifle was adopted as the M16 rifle. In 1963, Colt started selling the semi-automatic version of the rifle for civilians designated as the Colt SP1. Although the name "AR-15" remains a Colt registered trademark, variants of the firearm are made, modified, and sold under various names by multiple manufacturers.

Given the popularity of the AR-15, as well as other rifles, shooters frequently seek to modify their rifles to accommodate different calibers of ammunition such as .308, 9 mm, .45, 5.56 mm, etc. Current processes and kits for converting a rifle between caliber variants are time consuming and often of limited use as a conversion kit for 9 mm would not enable a shooter to also convert to 5.56 mm or .308.

Various prior art conversion systems exist. For example, Brown, U.S. Pat. No. 5,046,275, provides an improvement for a caliber conversion kit for semi-automatic and automatic firearms to allow the use of smaller caliber ammunition within. The conversion kit comprises the replacement of the bolt, barrel and magazine clip of the existing firearm so that the firing speed and thus the action or feel is similar to a standard non-modified firearm having larger caliber ammunition. However, U.S. Pat. No. 5,046,275 uses a unified striker bolt and blot housing moving as a single unit as well as a modified ammunition magazine.

Barnes et al., U.S. Pat. No. 4,463,654 discloses an assault rifle converted from an original to a modified configuration having a remote trigger located forward of the magazine by mounting a remote forward trigger to the original rifle by means of a pair of shroud pieces which cradle the rifle's receiver, replacing the original removable trigger of the assault rifle with a replacement lever, providing a cam element movable within cam guides defined in the shroud pieces and connecting the cam element to the remote forward trigger so as to move the cam into engagement with the replacement lever upon actuation of the remote forward trigger. The parts required for conversion are readily detachable from the rifle to thereby return the weapon to its original configuration.

Robinson, et al., U.S. Pat. No. 5,900,577 discloses a weapon reconfiguration wherein the following components are changed: barrel, operating rod, recoil spring, buffer, gas tube, bolt head, firing pin, extractor, and magazine well.

Lambie, U.S. Pat. No. 6,212,814 discloses an apparatus for converting a semi-automatic weapon into a single shot weapon. The lower receiver is replaced by a lower receiver that has no magazine well. The replacement receiver contains a loading block that can be loaded through the ejection chamber of the weapon. A spring biased plunger is provided in the replacement receiver for moving the bolt catch into a holding position, when the bolt is moved into a battery position. In a second embodiment of the invention a dummy magazine is permanently secured in the magazine well and contains a loading block that can be loaded with a cartridge through the ejection port of the weapon. A spring biased plunger is mounted in the dummy magazine behind the loading block that is arranged to bias the bolt catch of the weapon into a bolt retaining position when the bolt is in a battery position.

Brandl, et al., U.S. Pat. No. 6,250,194, provides a multi-purpose weapon having a self-loading large-caliber module or section and an assault weapon module or section attached to the front portion. A first trigger assembly of the large caliber rifle is positioned for operation by a trigger hand of the user of the weapon, While a second trigger assembly of the assault weapon module is configured for operation by the non-trigger hand of the user. Alternatively, the assault weapon section or module can be equipped with a trigger that is selectively operable to fire either the assault weapon module or the large-caliber rifle module. Additionally, a detachable secondary module comprising a grip module, which includes a grip and a trigger, can alternatively be attached to the large-caliber module. This invention provides simultaneous firing of different calibers via attaching an additional firing mechanism to the weapon.

Brown, U.S. Pat. No. 4,920,678 discloses An improvement for a caliber conversion kit for semi-automatic and automatic firearms to allow the use of smaller caliber ammunition within. The conversion kit comprises the replacement of the bolt, barrel and magazine clip of the existing firearm so that the firing speed and thus the action or feel is similar to a standard non-modified firearm having larger caliber ammunition.

Accordingly, it is an object of the present invention to provide a rifle caliber conversion assembly to convert rifles between different caliber combinations with minimal mechanical effort in order to provide a variable weapon not limited to one specific type of ammunition or weapon platform.

SUMMARY OF THE INVENTION

In a first embodiment, the current disclosure provides a caliber modification system. The system may include a fire control group, a fore module, and a rear module. The fire control group, fore module, and rear module when combined fit into an existing rifle platform. In a further embodiment, the fire control group, fore module, and rear module are separable from one another. Still further, the fire control group and rear module are unitary and the fore module is separable from the unitary fire control group and rear module. Even further, a barrel may be added as part of the caliber modification system. Even further yet, the fore module accommodates ammunition of a particular caliber. Further still, a replacement fore module with a caliber different from that of the fore module may be interchanged with the fore module to accommodate a different caliber.

In a further embodiment, a method for changing the caliber of a weapon is provided. The method includes attaching a fore end to the rifle, the fore end having a defined caliber, attaching a fire control group to the fore end, attaching a rear module to the fire control group, attaching the combined fore end, fire control group, and rear module to the rifle, and attaching a barrel with a caliber matching that of the fore end. Still further, the fire control group and rear module are unitary and the fore module is separable from the unitary fire control group and rear module. Further, a barrel may be added as part of the caliber modification system. Still further, the fore module accommodates ammunition of a particular caliber. Further still, a replacement fore module with a caliber different from that of the fore module may be interchanged with the fore module to accommodate a different caliber.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

Figure 1:
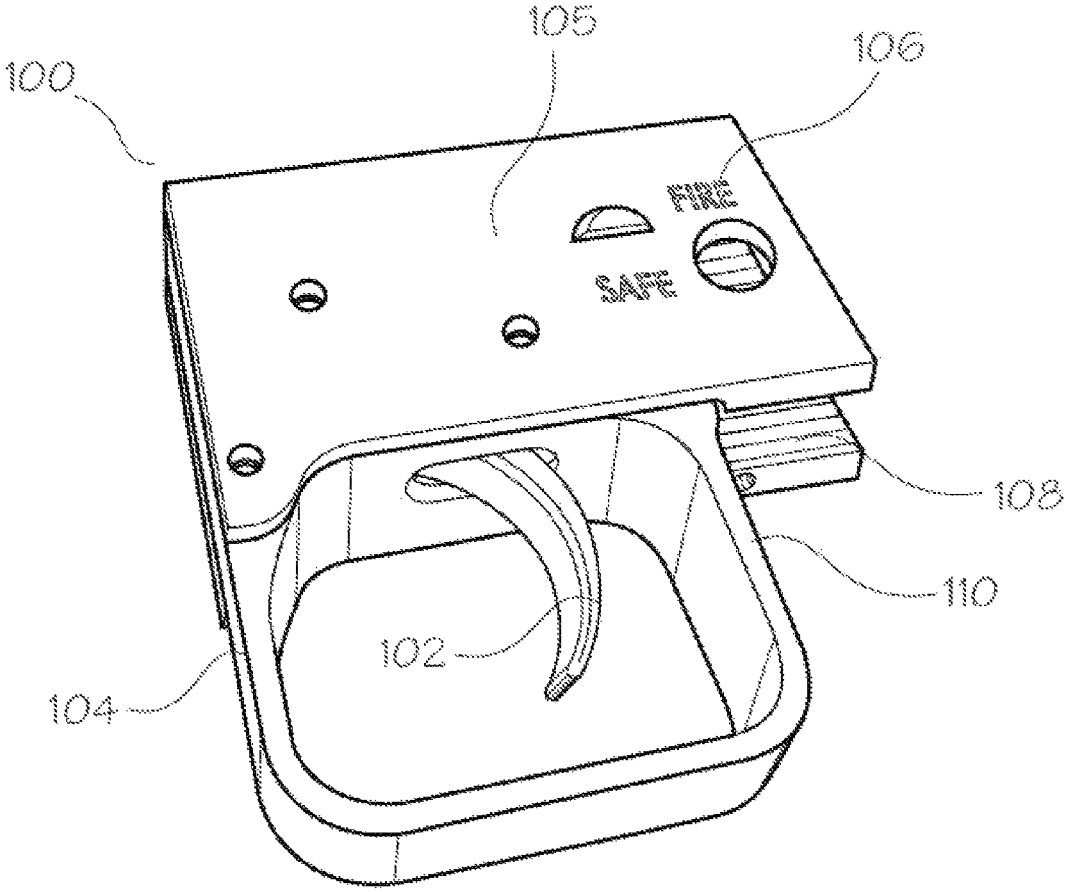
FIG. 1 shows one embodiment of a fire control group of the present disclosure.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below, and will be readily apparent to those skilled in the art. Such objects, features, benefits and advantages will be apparent from the above in conjunction with the accompanying examples, data, figures and all reasonable inferences to be drawn therefrom, alone or with consideration of the references incorporated herein.

DETAILED DESCRIPTION OF A PREFERRED EMBODIMENT

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

In one embodiment, an independent fire control group is provided that is independent of a final rifle configuration, whereas in prior art configurations, the fire control group is typically part of the receiver of a rifle or weapon platform.

The fire control group of the current disclosure represents "drop in" technology wherein the fire control group is dropped into a fire control group well in a rifle. FIG. 1 shows one embodiment of fire control group 100. FIG. 1 shows trigger 102, trigger guard 104, fire control group left side 106, fire control group right side 108, and fire control group spacer 110. One aspect of the current disclosure is that this fire control group along with a fore end and rear module, see FIG. 2, will be compatible with existing rifle platforms such that these three components may be used to convert a rifle from one caliber to another with minimal effort by simply inserting the fire control group, fore end and rear module into an existing rifle along with a new barrel.

Fire Control Group 100 may be made from the following materials; aluminum, steel, titanium, and polymers. Coatings 105 may also be applied to fire control group 100, including, but not limited to, Teflon based coatings, Nickel based coatings, including Nickel Boron and Nickel Teflon coatings, chrome based, phosphates, black oxide, etc., as known to those of skill in the art.

Figure 2:
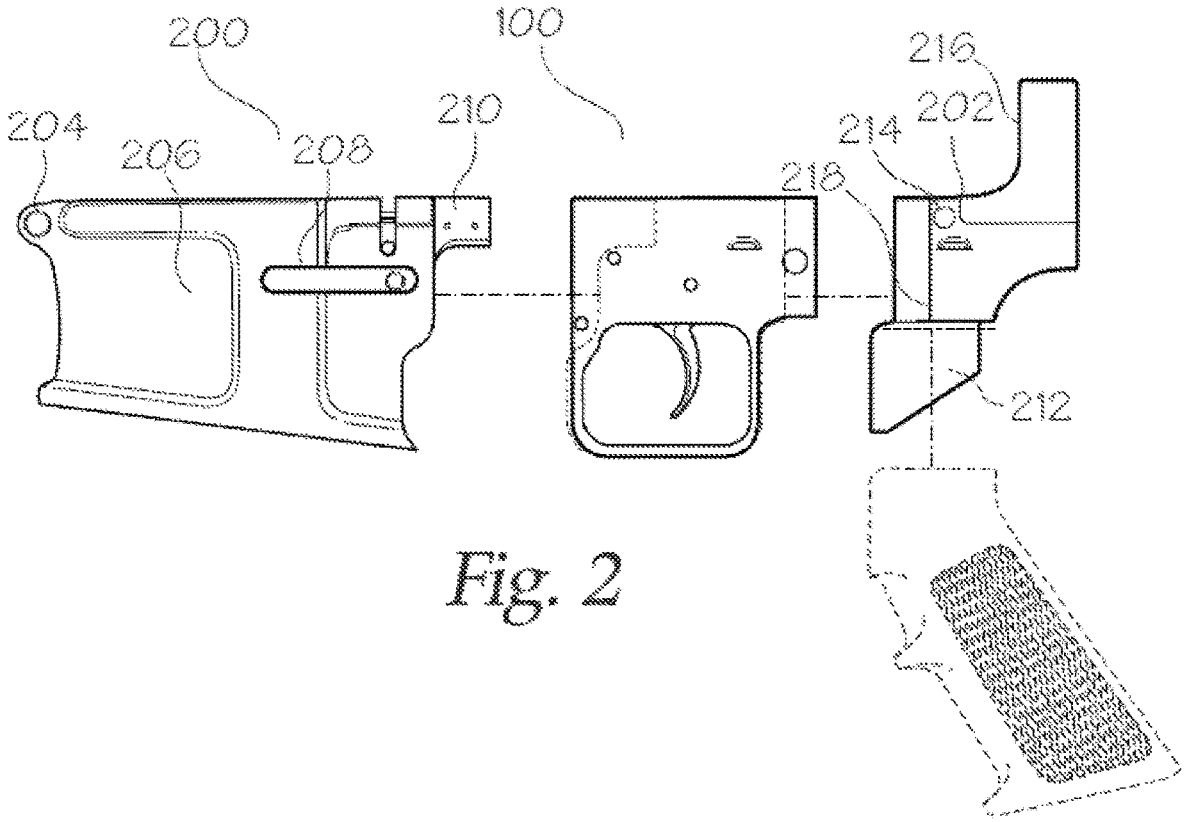
FIG. 2 illustrates a fire control group along with a fore end and rear module of the current disclosure.

FIG. 2 shows fire control group 100 with fore end 200 and rear module 202. Fore end 200 includes pivot pin 204, magazine well 206, magazine release aperture 208, and fore end fire control group interface 210 for attaching fore end 200 to fire control group 100. Fire control group 100 may be attached to the other components of the conversion system via pins, rivets, frictional engagement, adhesives, welding, etc. In a preferred embodiment, pins affix fire control group 100 to the other portions of the conversion kit. Rear module 202 includes grip handle mounting 212, take down pin aperture 214, rear stock/buffer tube interface 216, and rear module fire control group interface 218. Fore end 200 may be made from aluminum, steel, stainless steel, titanium, and/or polymers and rear module 202 may be made from aluminum, steel, stainless steel, titanium, and/or polymers.

With respect to FIG. 2, in use, the shooter would remove the lower from the existing weapon, e.g., an AR-15. The lower would then be replaced with the fore-end 200, fire control group 100, and rear module 202. When one wishes to change from 9 mm to 3.56 mm ammunition, one could simply replace fore-end 200 and rear module 202 to accommodate the magazine and buffer system for the new caliber ammunition. This provides an essentially "plug and play" type conversion group wherein the shooter only needs to change the fore end, rear module, bolt, and barrel to accommodate the new caliber ammunition.

Figure 2A:
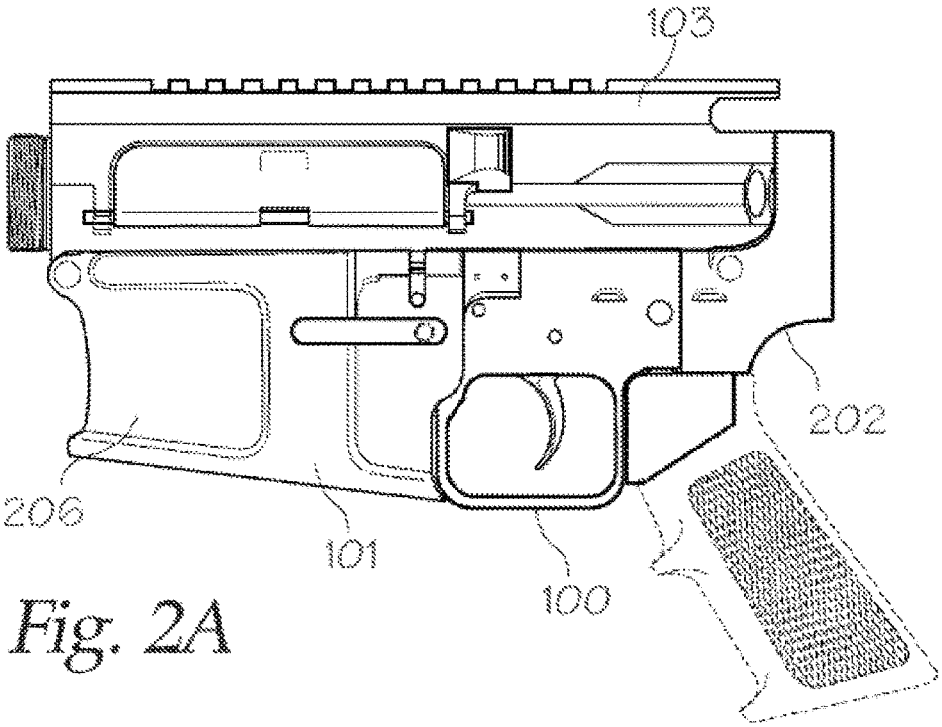
FIG. 2A shows a fire control group, rear module, and magazine well of the current disclosure assembled on a rifle upper.

Referring to FIG. 2A, which shows fire control group 100, rear module 202, and magazine well 206 assembled, fire control group 100 may be considered the "backbone" of the lower receiving section 101 of a rifle platform. In a further embodiment, fire control group 100 may be configured to insert into a rifle upper 103 like a magazine of ammunition fits into a magazine well 206 in a rifle platform, so that fire control group 100 fits into and forms the backbone of the conversion kit.

Figure 3:
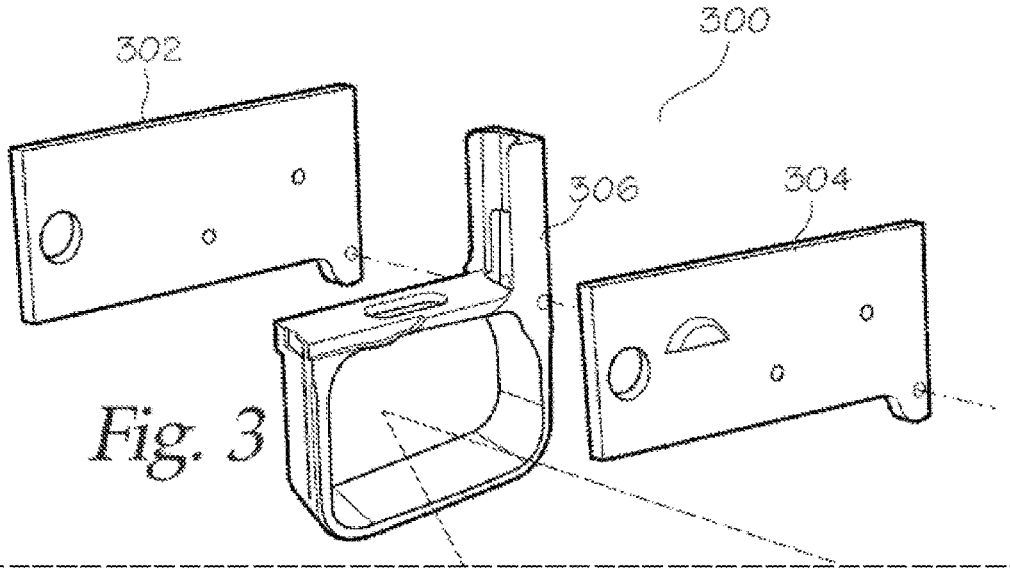
FIG. 3 shows a disassembled fire control module housing of the current disclosure, with left side, right side, and spacer.

FIG. 3 shows a disassembled fire control module housing 300 of the current disclosure, with left side 302, right side 304 and spacer 306.

Figure 4:
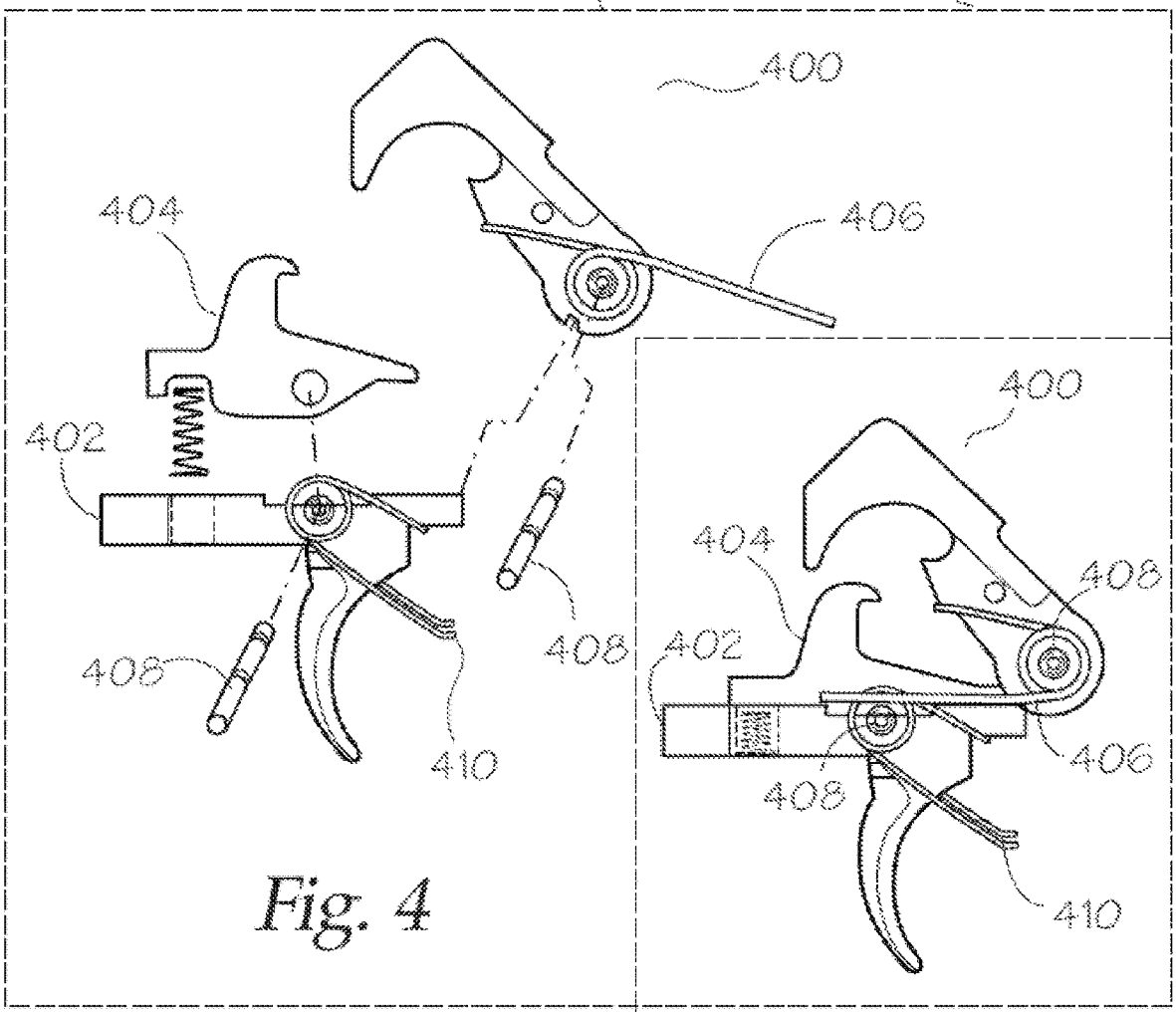
FIG. 4 shows one embodiment of the components that may reside within a fire control group of the current disclosure.

FIG. 4 shows one embodiment of the components that may reside within fire control group 100. These include hammer 400, trigger 402, disconnector 404, hammer spring 406, trigger pins 408, and trigger spring 410.

Figure 5:
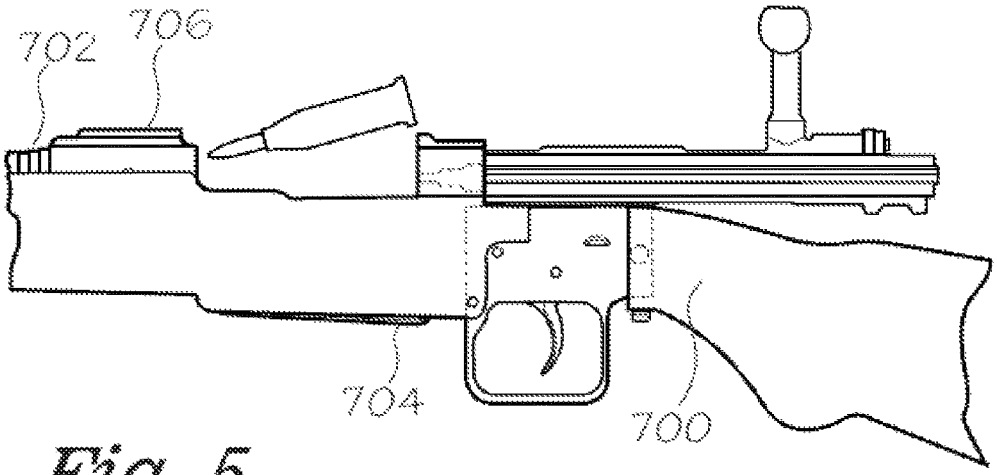
FIG. 5 illustrates a bolt action rifle.

With respect to FIG. 5, the current disclosure may be used to modify a bolt action rifle 700. This may be accomplished by removing barrel 702 and replacing it with a barrel from another rifle platform, such as the AR platform. Not only does this allow for caliber conversion, but also provides more headspace in the bolt action weapon. The current disclosure could then be used to modify bolt action rifle 700 by reconfiguring magazine floor plate 704 to accommodate fire control group 100, not shown, as well as reconfiguring receiver 706 to accommodate fire control group 100, when inserted. Thus, fire control group 100, would be used to allow a shooter to convert a bolt action rifle 700 between different calibers using fire control group 100 in conjunction with barrel 702 and receiver 706 to allow the shooter to quickly switch the barrel and receiver out for those of various calibers while fire control group 100 remains in place.

Figure 6:
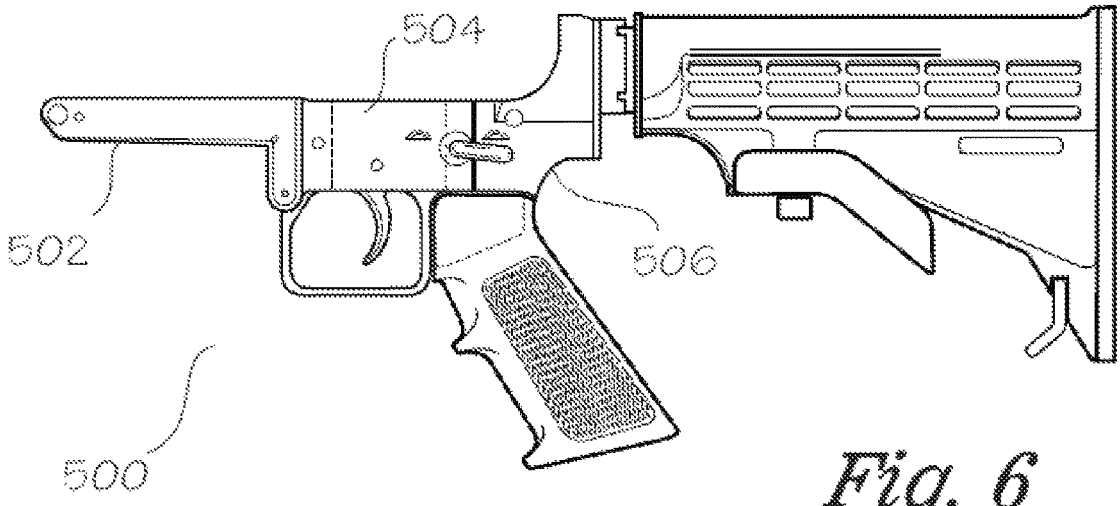
FIG. 6 shows an alternate embodiment weapon conversion lower.
Figure 6A:
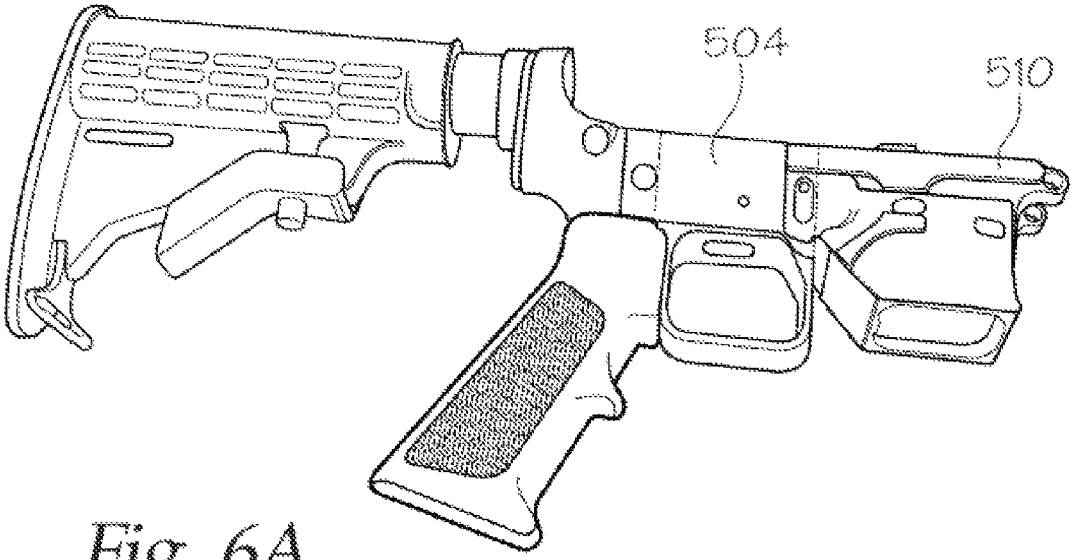
FIG. 6A shows a 9 mm magazine well used with a conversion kit of the current disclosure.
Figure 6B:
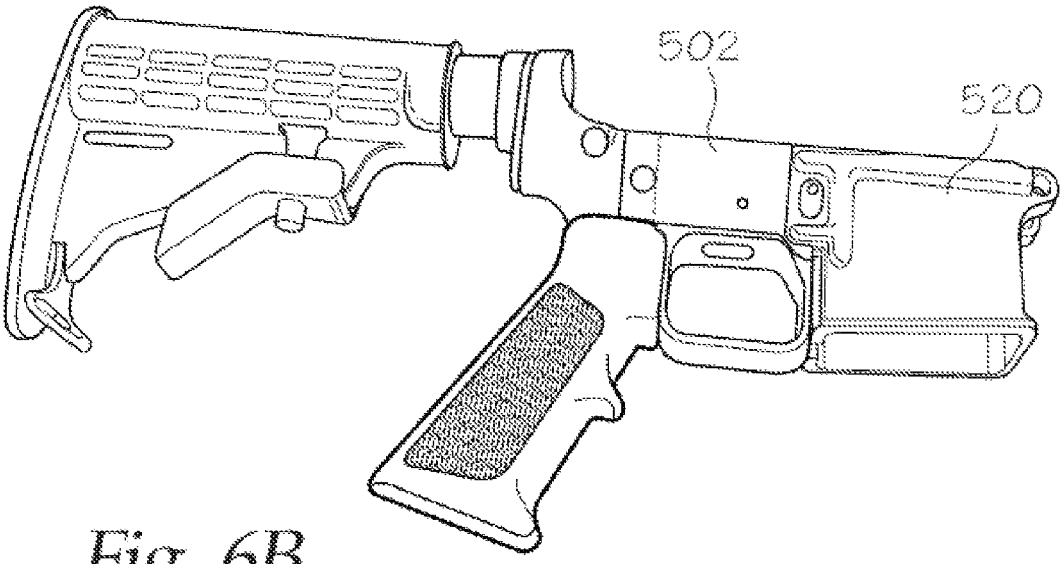
FIG. 6B shows an AR-10 magazine well used with a conversion kit of the current disclosure.

In an alternate embodiment, another weapon conversion system is provided. FIG. 6 shows a unified lower 500. Unlike the prior embodiment, the conversion process is achieved by replacing a weapon's existing lower, not shown, with unified lower 500. Magazine well 502 may be interchanged with respect to unified lower 500, and may be affixed by pins, rivets, etc., as known to those of skill in the art, to accommodate standard AR-15 magazines, and variants thereof, AK-47 magazines and variants thereof, as well as other caliber ammunition. The caliber conversion for this embodiment is accomplished by having a unified fire control group 504 that is unitary with lower receiver 506 but magazine well 502 may be interchanged for various caliber magazines and the barrel of the weapon may be interchanged to accommodate the different caliber ammunition. For instance, as seen in FIG. 6A, a 9 mm magazine well 510 may be affixed to unified fire control group 504. FIG. 6B shows that an AR-10 magazine well 520 may be affixed to unified fire control group 504 to accommodate AR-10 ammunition.

Figure 7A:
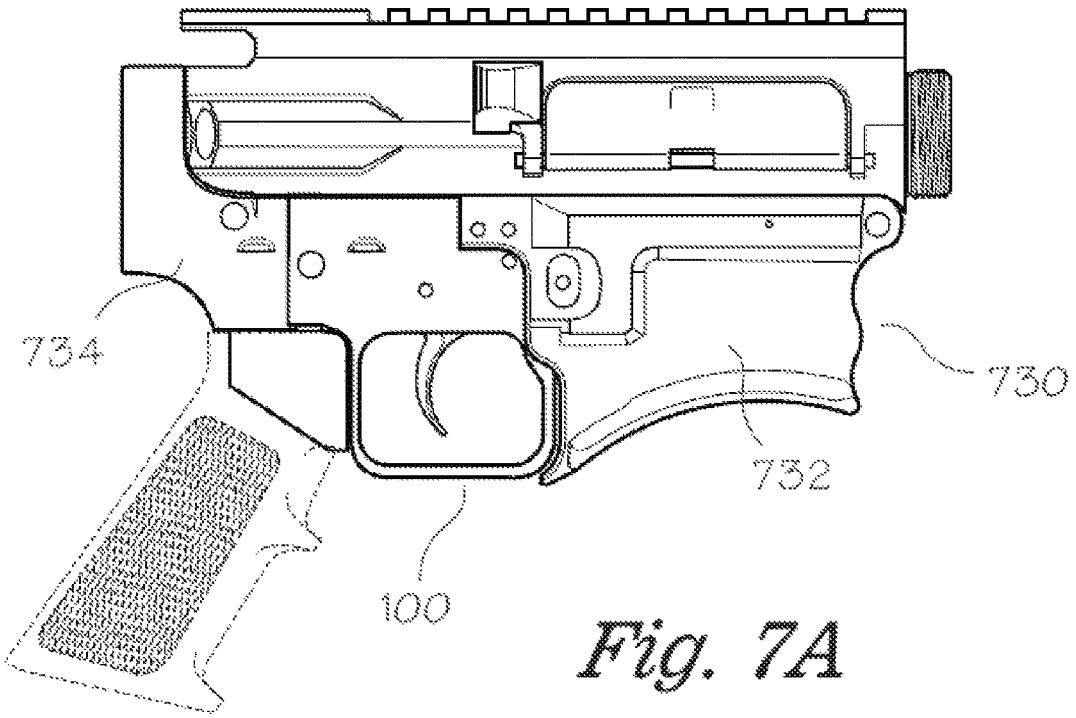
FIG. 7A shows a weapon configured for 5.56×45 5.45 ammunition.
Figure 7B:
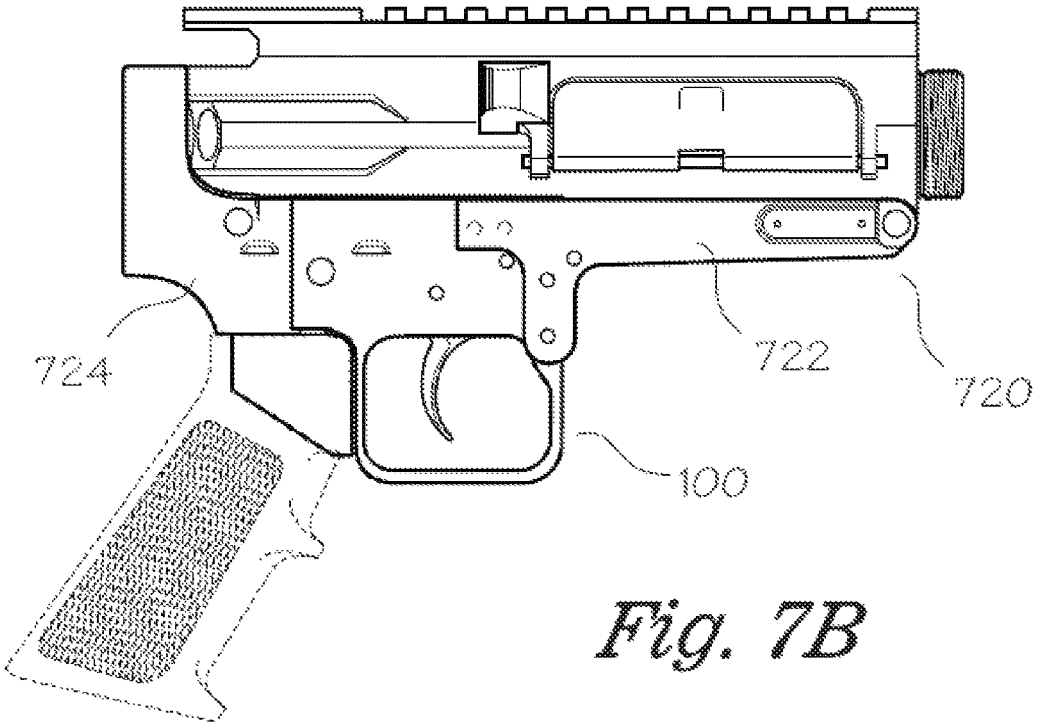
FIG. 7B illustrates a weapon configured as an AK-47 variant.
Figure 7C:
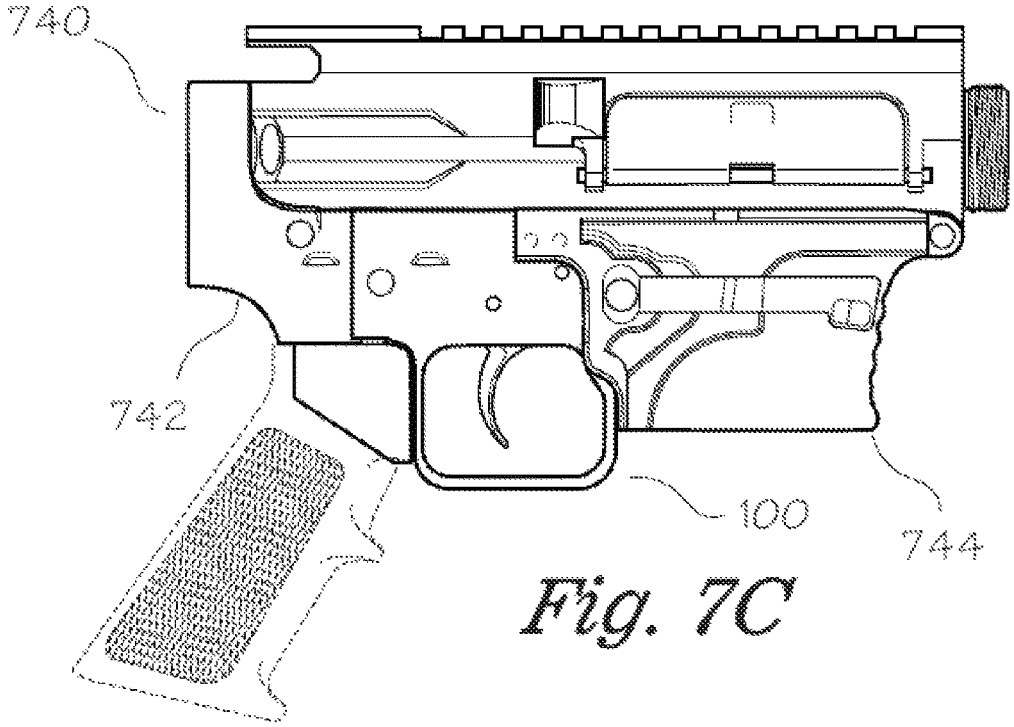
FIG. 7C shows a weapon configured to fire .45 ACP ammunition.
Figure 7D:
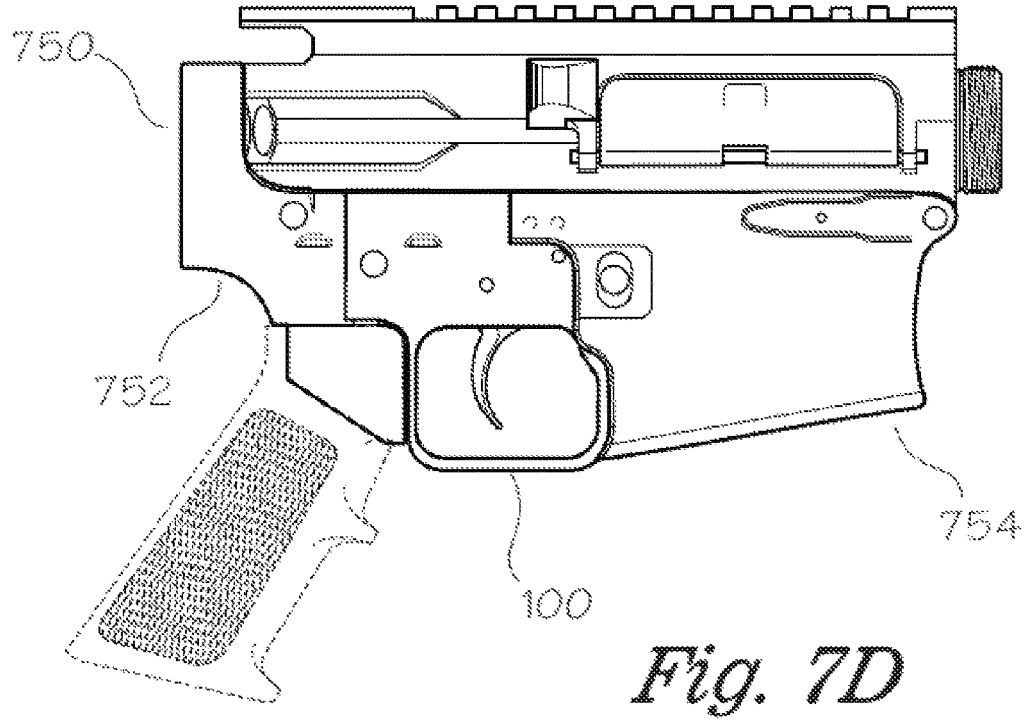
FIG. 7D shows a weapon configured to fire 9 mm ammunition.

FIG. 7A-7D illustrate various configurations of a variable caliber weapons platform of the current disclosure. For example, FIG. 7A illustrates a weapon 730 configured for AR-15 5.56×45 5.45, 300 blackout having fire control group 100, fore end 732, and rear module 734. Here, fore end 732 and rear module 734 are configured to accommodate 5.56×45 mm caliber ammunition. FIG. 7B, meanwhile, shows a weapon 720 configured as an AK-47 variant with fire control group 100, fore end 722 and rear module 724. Fore end 722 and rear module 724 are both configured to accommodate 7.62×39 mm caliber ammunition, as used in AK-47 variants. FIG. 7C shows a weapon 740 with fire control group 100, fore end 742, and rear module 744. Fore end 742 and rear module 744 have been configured to fire 45 ACP ammunition. FIG. 7D shows weapon 750 with fire control group 100. Here, fore end 752 and rear module 754 have been configured to fire 9 mm ammunition. As FIGS. 7A-7D illustrate, a host of calibers may be employed by a single weapon platform simply by interchanging fore ends and rear modules while keeping the original fire control group. For instance, additional configurations may include AR-10 7.62×51 ammunition or other types as known to those of skill in the art.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. A caliber modification system comprising:

an independent fire control group comprising a trigger;

a fore end comprising a fore end fire control group interface;

a rear module that interfaces with the independent fire control group and further comprises a buffer tube interface;

wherein the fire control group, fore end, and rear module are removably affixed and separable from one another and combine to form a three-part lower receiver configured to interface with an upper receiver;

wherein the three-part lower receiver is compatible with an existing rifle platform to change the rifle platform caliber to a different caliber via replacing a lower receiver with the three-part lower receiver.

2. The caliber modification system of claim 1 wherein a barrel is added as part of the caliber modification system.

3. The caliber modification system of claim 1, wherein the fore end accommodates ammunition of a particular caliber.

4. The caliber modification system of claim 2, wherein a replacement fore end with a caliber different from that of the fore end may be interchanged with the fore end to accommodate a different caliber.

5. A method for changing the caliber of a weapon comprising:

removing a lower receiver from the weapon;

attaching a multi-part lower receiver to the weapon;

wherein the multi-part lower receiver comprises an independent fire control group comprising a trigger, a fore end comprising a fore end fire control group interface, and a rear module that interfaces with the independent fire control group and further comprises a buffer tube interface;

wherein the fire control group, fore end, and rear module are removably affixed and separable from one another to form a three-part lower receiver; and attaching a barrel with a caliber matching that of the fore end fire control group.

6. The method of claim 5, wherein the fore end accommodates ammunition of a particular caliber.

7. The method of claim 5, wherein a replacement fore end with a caliber different from that of the fore end may be interchanged with the fore end to accommodate a different caliber.

* * * * *